United States Patent [19]

Kawawada et al.

[11] Patent Number: 4,734,060

[45] Date of Patent: Mar. 29, 1988

[54] CONNECTOR DEVICE

[75] Inventors: Kenji Kawawada; Akira Shimada, both of Tokyo, Japan

[73] Assignee: Kel Corporation, Tokyo, Japan

[21] Appl. No.: 866,485

[22] Filed: May 23, 1986

[30] Foreign Application Priority Data

Jan. 31, 1986 [JP] Japan ..... 61-17831

[51] Int. Cl.[4] ..... H01R 13/28

[52] U.S. Cl. ..... 439/660; 439/295; 439/862

[58] Field of Search ..... 339/172, 46, 47, 48, 339/49, 74 R, 75 MP, 176 MP, 176 MF, 220, 255, 206 R, 103 R; 439/284–295, 660, 862

[56] References Cited

U.S. PATENT DOCUMENTS

| | | | |
|---|---|---|---|
| 1,671,550 | 5/1928 | Semmens | 339/74 R |
| 2,005,441 | 6/1935 | Shearer | 339/74 R X |
| 3,218,599 | 11/1965 | Winkler | 339/47 R |
| 3,426,313 | 2/1969 | Wychek | 339/176 MP X |
| 3,523,273 | 8/1970 | Hammell et al. | 339/47 R X |
| 3,821,691 | 6/1974 | Reimer | 339/206 R X |
| 4,083,617 | 4/1978 | Wyatt | 339/47 R |

*Primary Examiner*—John McQuade

*Attorney, Agent, or Firm*—Birch, Stewart, Kolasch & Birch

[57] ABSTRACT

Connector device having rod-like male and female contact sections of the same shapes to contact each other while they are arranged substantially parallel to each other. Contact section guide walls opposing each other are formed in the connector body. Rod-like contact sections are provided between the opposing guide walls. The proximal end of each contact section is fixed to the connector body and the distal end thereof is free to be elastically deformed. A contact projection is formed on the distal end of the rod-like contact section. An inclined portion is formed between the contact projection and a fixing section at the proximal end of the contact section.

7 Claims, 23 Drawing Figures

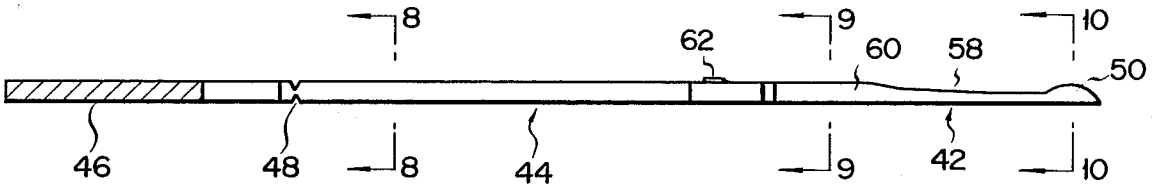
FIG. 7
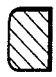
FIG. 8
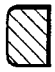
FIG. 9
FIG. 10

CONNECTOR DEVICE

BACKGROUND OF THE INVENTION (1) Field of the Invention

The present invention relates to an electric connector device and, more particularly, to an electric connector device having rod-like contact sections.

(2) Prior Art

In conventional electric connector devices, a male contact section and a female contact section are engaged with each other. The female contact section is, in general, elastically deformable. The female contact section is elastically deformed when the male contact section is inserted therein and contacts the male contact section by its elastic force. A tapered guide section is formed on the distal end of the female contact section. When the male contact section is inserted, its distal end abuts against the guide section, the male contact section is guided thereby, and the female contact section is elastically deformed.

Such conventional electric connector devices require a comparatively large force to engage the pair of male and female contact sections. Therefore, when a connector has a large number of contact sections, i.e., poles, a considerably large force is needed for engaging/disengaging the contact sections.

In the conventional electric connector, the female contact section is complex in shape and large in size, resulting in high manufacturing cost. Also, it is difficult to increase the packaging density of the connectors.

It is desired that a connector device have a highly-reliable electrical contact at its contact sections.

The present invention provides a connector device which eliminates the above conventional drawbacks and which provides a highly-reliable electrical contact.

SUMMARY OF THE INVENTION

It is an object of the present invention to reduce the size of a connector by causing rod-like male and female contact sections of the same shapes to contact each other while they are arranged substantially parallel to each other, and to increase the reliability of the electrical contact. According to the present invention, contact section guide walls opposing each other are formed in the connector body. Rod-like contact sections are provided between the opposing guide walls. The proximal end of each contact section is fixed to the connector body and the distal end thereof is free to be elastically deformed. A contact projection is formed on the distal end of the rod-like contact section. An inclined portion is formed between the contact projection and a fixing section at the proximal end of the contact section. When the pair of rod-like contact sections are engaged with each other, the distal ends thereof are elastically deformed and the contact projections climb over each other. The contact projections slide along the corresponding inclined portions, the distal ends of the contact sections are gradually bent, and the contact projections contact the corresponding contact sections under the elastic restoring force of the bent ends. Each inclined portion is formed closer to the proximal end than the contact projection on the distal end of the contact section is. The length of the inclined portion can thus be increased, thereby moderating the inclination. Therefore, the force required for engaging the contact sections can be made small. Even if the connector device has a plurality of contact sections, an excessively large force is not required for engaging/disengaging. The contact projection at the distal end of each contact section contacts the proximal end of the other contact section. As a result, one contact section contacts the other at two electrical contact points, resulting in a highly-reliable electrical contact. The contact sections have a rod-like shape and the rod-like contact sections contact each other as they are arranged substantially parallel to each other. Therefore, only a small space is occupied by the contact sections and the connector device can be made compact, resulting in high packaging density. Since the contact sections are housed between opposing guide walls of the connector main body, they may not be displaced, resulting in high reliability.

According to an embodiment of the present invention, a contact projection formed on the distal end of a contact section is rounded. The distal end of the contact section is gradually bent as the contact projection is slid along the inclined portion of the other contact section Thus, the contact point on the rounded contact projection with the inclined portion changes. This prevents local wear of the contact projection.

In addition, according to the present invention, a flat contact portion is formed contiguous with the end of the inclined portion of the contact section. The flat contact portion defines a predetermined angle with respect to the inclined portion. When the contact projection shifts from the inclined portion to the flat contact portion, the contact point on the contact projection with the flat portion shifts to a position different from that with the inclined portion. Since the slide point of the contact projection with the inclined portion is different from a final electrical contact point of the contact projection with the flat contact portion, the reliability of the electrical contact will not be degraded by wear.

BRIEF DESCRIPTION OF THE DRAWINGS

The present invention will be clearly understood by the following description of the embodiment with reference to the accompanying drawings, in which:

FIG. 7 is a sectional view taken along the line 7—7 of FIG. 6A;

FIGS. 8 to 10 are sectional views taken along the lines 8—8, 9—9, and 10—10 of FIG. 7, respectively;

DETAILED DESCRIPTION OF THE EMBODIMENT

Figure 1:
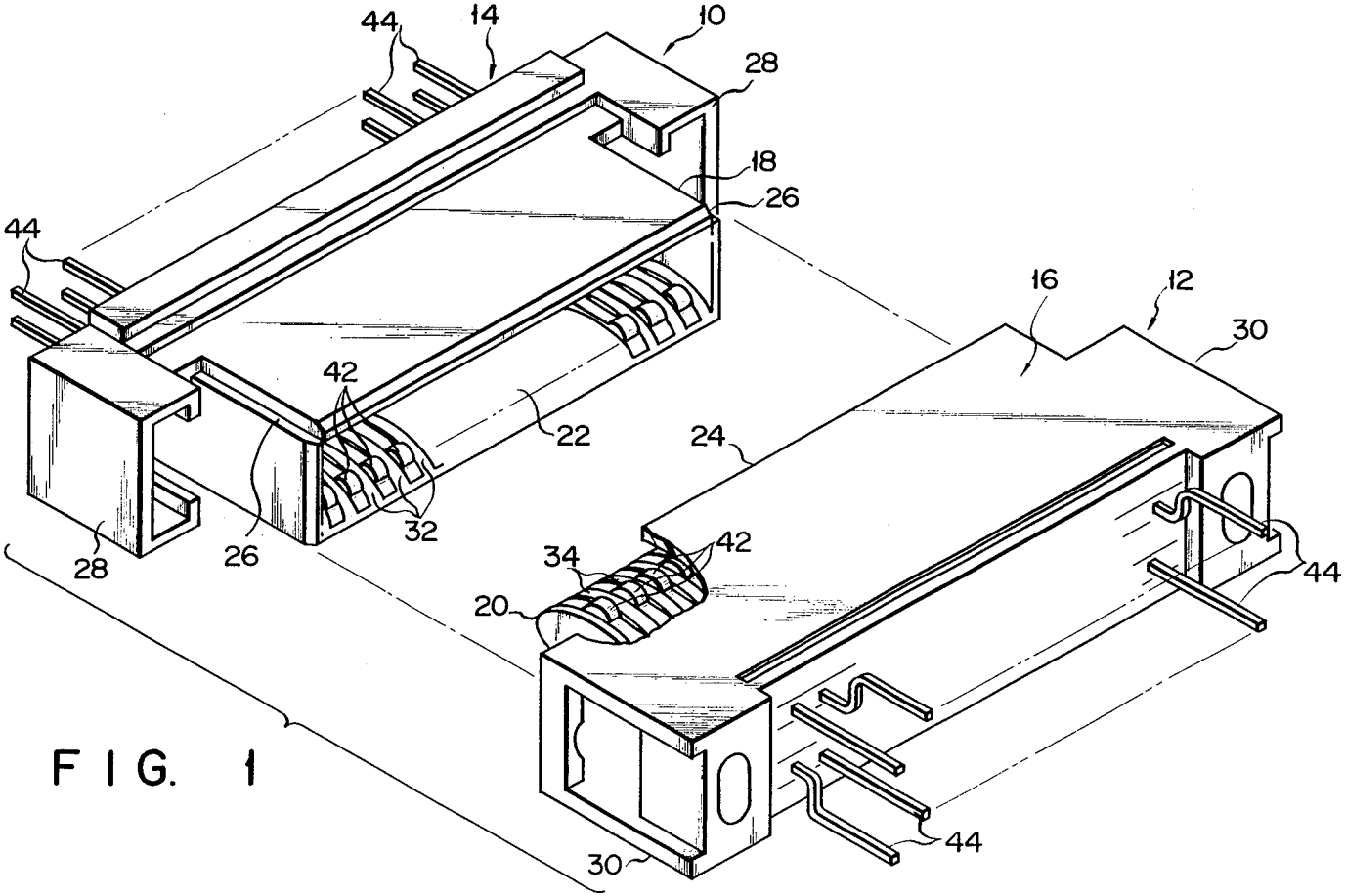
FIG. 1 is a perspective view of an embodiment of the present invention.
Figure 2:
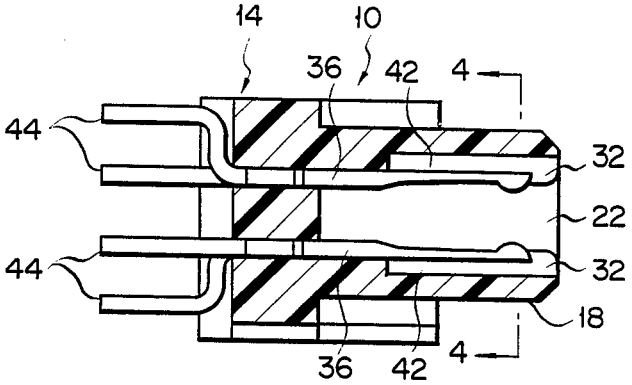
FIG. 2 is a longitudinal sectional view of a female connector according to the present invention.
Figure 3:
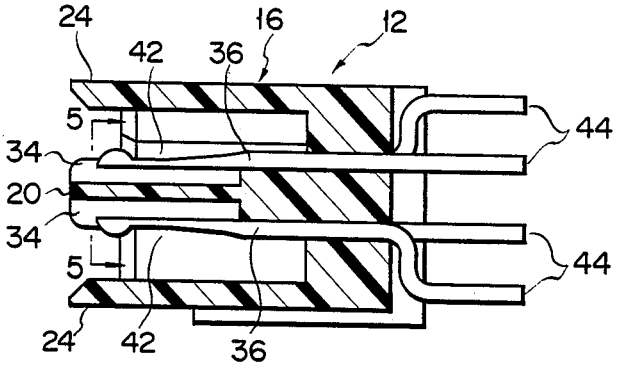
FIG. 3 is a longitudinal sectional view of a male connector according to the present invention.
Figure 4:
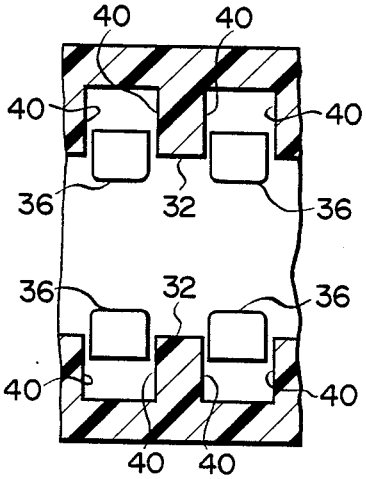
FIG. 4 is a sectional view taken along the line 4—4 of FIG. 2.
Figure 5:
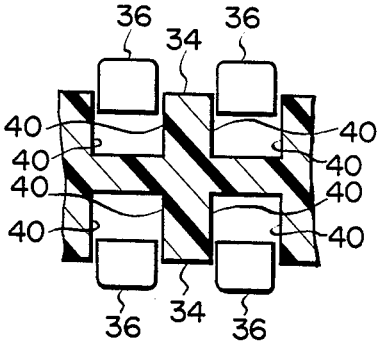
FIG. 5 is a sectional view taken along the line 5—5 FIG. of FIG. 3.

FIG. 1 shows a connector device according to an embodiment of the present invention. The connector device comprises female connector 10 and male connector 12. Connectors 10 and 12 have bodies 14 and 16, respectively. Connector bodies 14 and 16 are made of a synthetic resin material such as a polyamide resin containing reinforcing glass fibers, or a polyester resin, and has electrically insulating properties.

Body 14 of female connector 10 has an elongated box-like female engaging section 18. Hollow space 22 is formed in section 18 and opened in the front face thereof. Mounting sections 28 for mounting the connecter are formed on two opposing walls of the female engaging section 18.

Body 16 of male connector 12 has male engaging section 20. The section 20 is inserted in space 22 in section 18 of connector 10. Protection wall 24 is formed to surround section 20 and engages with the outer surface of section 18 of female connector 10. Mounting sections 30 are formed on two opposing sides of connector 12.

Positioning recess 26 is formed in an upper corner of section 18 of female connector 10. A positioning projection (not shown) corresponding to recess 26 is formed on the inner surface of wall 24 of male connector 12. Therefore, female and male connectors 10 and 12 can be engaged only when recess 26 and the projection oppose each other. This prevents connectors 10 and 12 from engaging in an erroneous position.

Two rows of a plurality of contact members 36 are arranged in female and male connectors 10 and 12. The structure of members 36 and a mounting structure there for will be described below.

Members 36 have a shape as shown in FIGS. 6 to 11. Members 36 are obtained by press-molding an elastic metal material such as phosphor bronze, forming the resultant structure to a predetermined shape, and plating it with nickel and then with gold.

Members 36 have contact sections 42 and terminals 44. Each contact section 42 has a belt-like shape and has a rounded (e.g., arcuated) contact projection 50 on a distal end thereof. Inclined portion 58 is formed at a portion of contact projection 50 on the side of the proximal end of section 42. Portion 58 has a considerable length. Flat contact portion 60 is formed to be contiguous with the end of portion 58. In this embodiment rod-like terminal 44 is employed.

A plurality of projecting guide ribs 32 are formed on upper and lower inner surfaces of section 18 of female connector 10 A plurality of projecting guide ribs 34 are formed on upper and lower surfaces of section 20 of the male connector 12. When connectors 10 and 12 are engaged, top surfaces of respective ribs 32 and 34 oppose each other. The side surfaces of ribs 32 and 34 serve as guide surfaces. Sections 42 of members 36 are housed between guide surfaces of ribs 32 and 34 along the axial direction, i.e., along the engaging direction of the connectors.

Figure 6A:
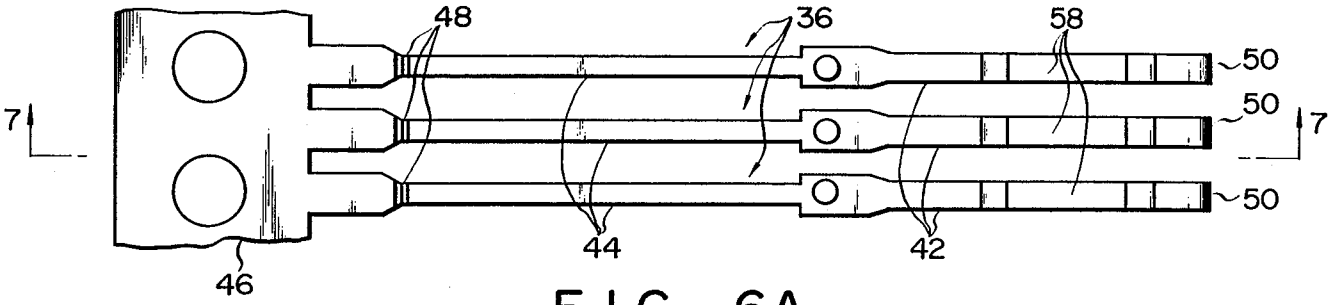
FIG. 6A is a plan view of a contact member.

As shown in FIG. 6A, a plurality of members 36 extend from a belt-like base 46 via cutting notch portions 48. Members 36 are subjected to final plating under this state and simultaneously inserted in predetermined positions in main bodies 14 and 16 of connectors 10 and 12. Notches 48 are then cut to separate members 36. Removal-preventing projections 62 are formed on members 36. While members 36 are inserted in main bodies 14 and 16 of connectors 10 and 12, inclined portions 58 and contact projections 50 of contact sections 42 are free to be bent and deformed. In a free state, one-half portion of each section 42 along the direction of its height is housed between guide surfaces 40 of projecting guide ribs 32 and 34, and the remaining half portion projects from the top surfaces of ribs 32 and 34.

FIGS. 8, 9, and 10 are sectional views taken along the lines 8—8, 9—9, and 10—10 of FIG. 7. As shown in FIG. 8, the section of terminal 44 of member 36 is substantially square and four edges thereof are chamfered. As shown in FIGS. 9 and 10, portion 60 and projection 50 have substantially similar rectangular sections and the edges thereof near contact points are chamfered.

Terminals 44 of members 36 project from the rear surfaces of main bodies 14 and 16 of connectors 10 and 12. Terminals 44 are inserted in through holes in a printed circuit board (not shown) and soldered thereto.

Figure 17:
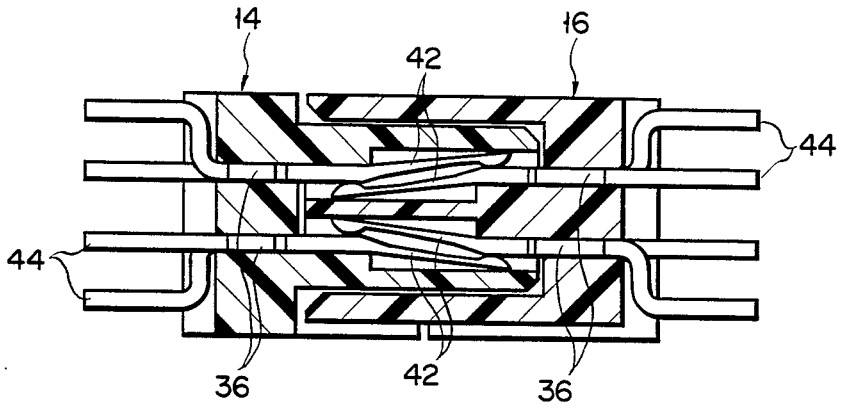
FIG. 17 is a longitudinal sectional view wherein the connectors shown in FIGS. 2 and 3 are engaged.
Figure 18:
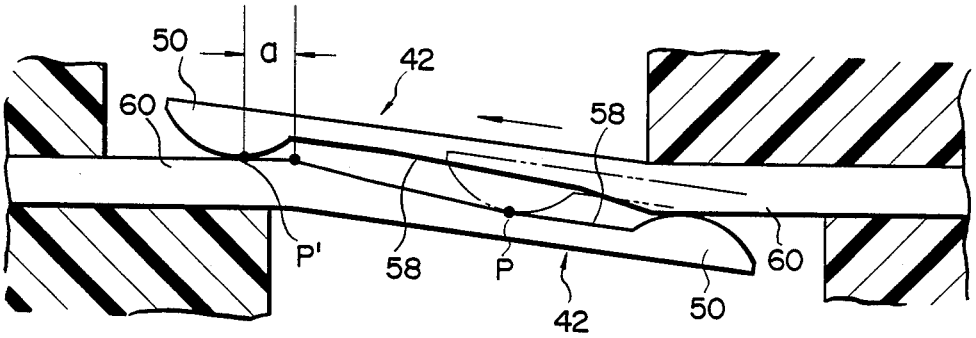
FIG. 18 is a view for explaining an engaging state of the contact sections.

When female and male connectors 10 and 12 are engaged, contact projections 50 of contact sections 42 thereof are first abutted against each other. The distal ends of sections 42 are bent in opposite directions and projections 50 climb over each other. Projections 50 are then slid along inclined portions 58 of corresponding sections 42, bent by portions 58, and finally climb over flat contact sections 60 as shown in FIG. 17. Then, projections 50 are urged against portions 60 by the elastic force of bent sections 42, thereby achieving an electrical contact.

Since sections 42 are guided by guide surfaces 40, they are not displaced, thereby attaining a stable contact. Sections 42 project from the top surfaces of the projecting guide ribs with about one-half their height exposed. Therefore, when connectors 10 and 12 are engaged, the projecting portions of sections 42 of one connector are inserted between the projecting guide ribs of the other connector, in order to guide engagement of the connectors and reliably prevent displacement of the connectors during engagement.

Figure 6B:
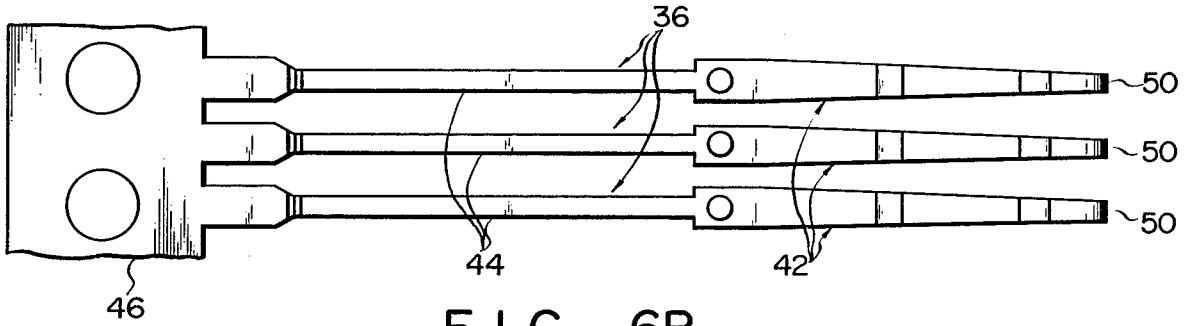
FIG. 6B is a plan view of other contact member used in the present invention.

The shape of member 36 can be tapered as shown in FIG. 6B.

Figure 11:
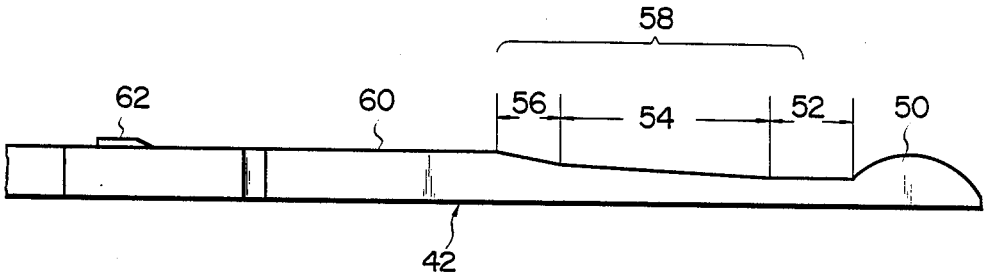
FIG. 11 is a side view of a distal end of a contact section.

Each inclined portion 58 is divided sequentially into first, second, and third inclined parts 52, 54 and 56 from its distal end as shown in detail in FIG. 11. The nearer to the proximal end, the steeper the inclination of parts 52, 54 and 56. In this manner, when a plurality of inclined parts of different inclinations are combined, the pushup distance and pushing force of the contact projections can be adequately distributed.

Portion 58 is formed closer to the proximal end of section 42 than projection 50 is. Thus, portion 58 can be set sufficiently long and can be extended to correspond to the entire length of section 42, thereby providing a sufficient length. As a result, the inclination of portion 58 can be moderated and the force required for inserting section 42 when projection 50 is slid along portion 58 and pushed up can be minimized. A plurality of connection members can thus be provided in a single connector. The average inclination of portion 58 preferably falls within the range of 3° to 30° and more preferably about 11°.

Portion 58 consists of a plurality of inclined parts of different inclinations. In addition, projection 50 is rounded. Therefore, when projection 50 is slid onto portion 58, contact point P of projection 50 with portion 58 changes. One section 42 is gradually bent as projection 50 thereof is slid onto portion 58 of the other corresponding section 42. Therefore, the angle of one section 42 with respect to the other changes gradually, thereby shifting contact point P thereof with portion 58. The slide point of section 42 with portion 58 is thus not limited to one fixed point, thereby preventing local wear of projection 50.

In this embodiment, flat contact portion 60 is not inclined and defines an angle different from that defined by portion 58. Therefore, when projection 50 has climbed over portion 60, contact point P′ of projection 50 with portion 60 is different from slide point P with portion 58. This minimizes wear at point P′, thus preventing degradation in electrical contact characteristics caused by wear. Note that wiping area a is provided, along which projection 50 is slid for a predetermined distance after it has climbed over portion 60, so that the surface of point P′ is cleaned.

Two opposing contact sections 42 contact each other at two points, thus providing a highly reliable electrical contact. Sections 42 have a rod-like shape and contact each other as they are stacked parallel to each other to occupy only a small space, thereby making the entire connector compact and resulting in a high packaging density.

The shape of section 42 of member 36 is not limited to that described above.

Figure 12:
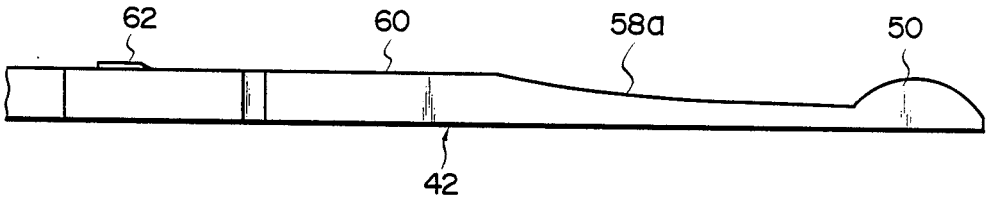
FIGS. 12 to 15 are side views of contact sections according to other embodiments.
Figure 13:
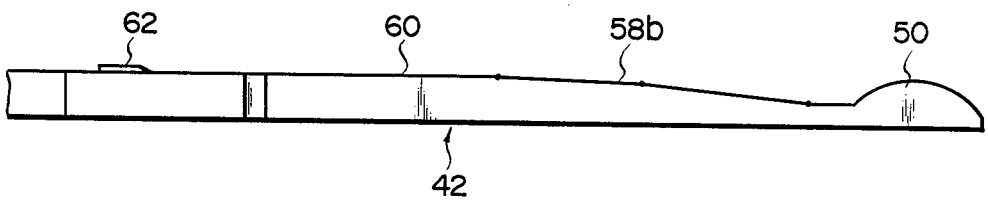
Figure 14:
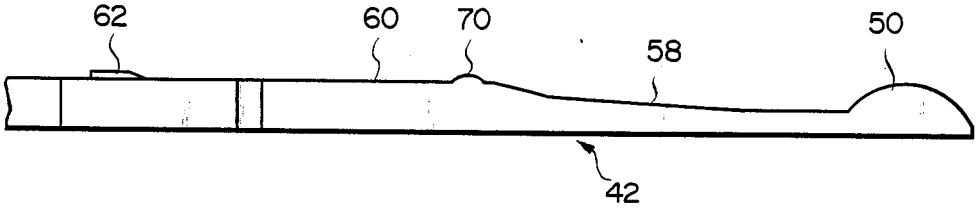
Figure 15:
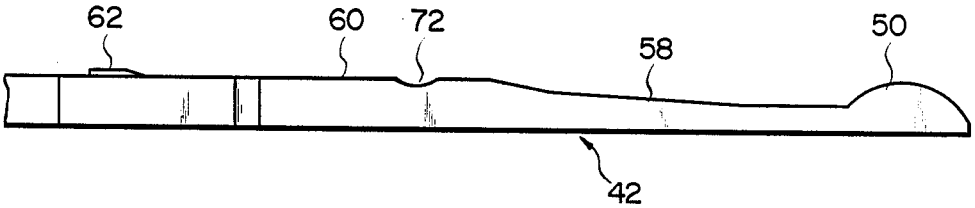

For example, the inclined portion can be a continuous curved surface, as inclined portion **58*a* shown in FIG. 12. Inclination of the inclined portion also can be gradually moderated, as inclined portion 58*b* shown in FIG. 13, toward a proximal end thereof. Projection 70 can be formed on flat contact portion 60 as shown in FIG. 14. Recess 72 can be formed in portion 60 as shown in FIG. 15. In FIGS. 14 and 15, projection 50 climbs over portion 60 with a click to prevent removal of projection 50**.

Figure 16:
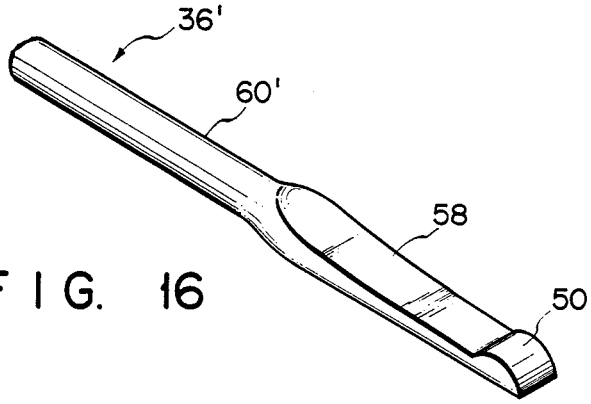
FIG. 16 is a perspective view of a contact section according to still another embodiment.

FIG. 16 shows contact member 36′ which is obtained by press-molding a round rod and forming inclined portion 58 and contact projection 50 thereon. Portion 60′ of member 36′, corresponding to a flat contact portion, has a circular column shape, and projection 50 is formed to constitute a circular column surface perpendicular to portion 60′. As a result, projection 50 and portion 60′ contact in a cross-bar manner, thereby achieving good electrical contact characteristics.

Figure 19:
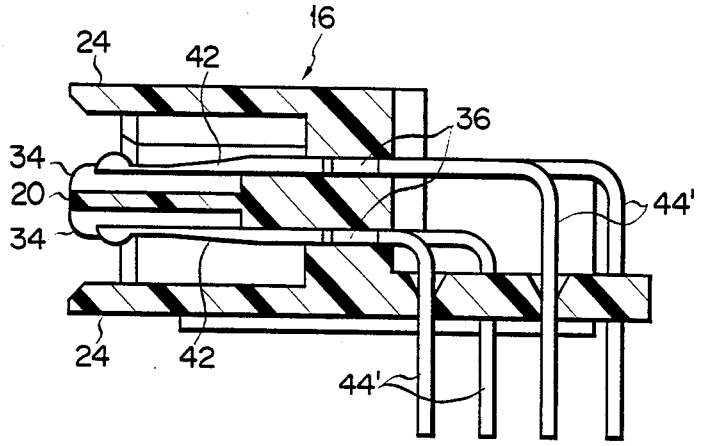
FIG. 19 is a longitudinal sectional view of a connector according to still another embodiment.

FIG. 19 shows another embodiment of the present invention. In FIG. 19, terminal 44′ of a connector is bent through a right angle so that the connector can be mounted on a printed circuit board such that the axial direction of the connector is parallel to the printed circuit board.

Figure 20:
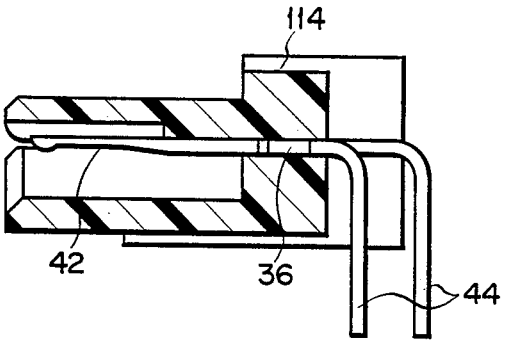
FIG. 20 is a longitudinal sectional view of a connector according to still another embodiment.
Figure 21:
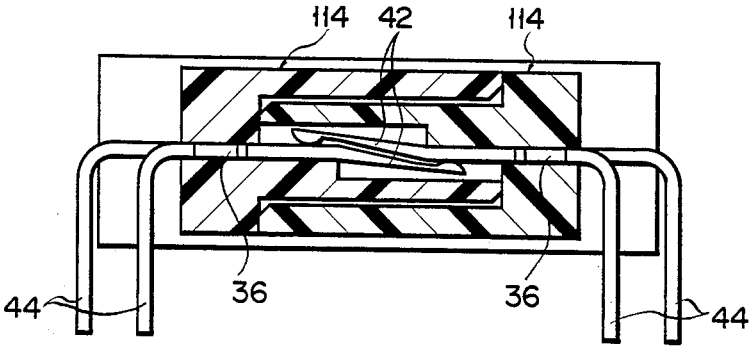
FIG. 21 is a longitudinal sectional view wherein the connector shown in FIG. 20 is engaged.

FIG. 20 shows still another embodiment of the present invention. In FIG. 20, contact members 36 are aligned in a row. Body 114 of the connector is constituted such that connectors of the same shape can be engaged as shown in FIG. 21.

Figure 22:
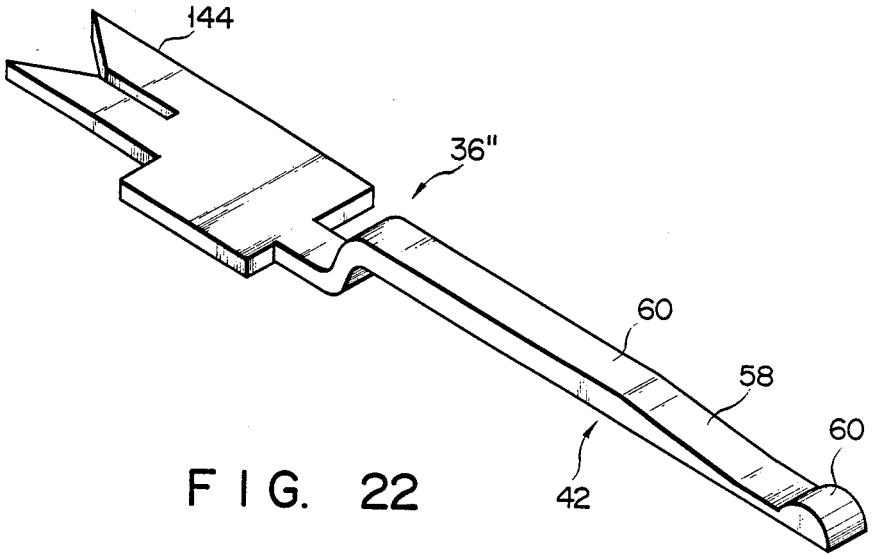
FIG. 22 is a perspective view of a contact member according to still another embodiment.

Press terminal 144, shaped to allow tight contact with a flat cable, can be formed as a terminal of contact member 36″ as shown in FIG. 22. In this case, the connector can be used as a flat cable connector.

The contact sections of the contact member can be aligned in three or more rows. The contact sections need not be arranged in a straight line. When the present invention is applied to a round connector, the contact sections can be aligned in a circular manner.

The female projecting guide rib and the male projecting guide rib can be engaged with each other and the contact section can be housed between the engaged ribs.

The present invention is not limited to the above embodiments. Various changes and modifications can be made by one with ordinary skill in the art without departing from the spirit and scope of the present invention.

What is claimed is:

1. A connector device comprising:

a pair of connector bodies engaged with each other;

a plurality of contact members provided in each of said connector bodies;

a plurality of guide surfaces formed in each of said connector bodies;

a contact section for each of said contact members extending between said guide surfaces along an engaging direction of connectors of said device, said contact section having a free distal end which is elastically deformable and guided by said guide surfaces, and opposing contact sections being parallel to and in contact with each other when said connectors are engaged;

a contact projection formed on the distal end of said contact section, wherein an inclined portion is formed on said contact section closer to a proximal end thereof than said contact projection; and a flat contact portion formed on said contact section contiguous with the end of said inclined portion, said flat contact portion resting on a back surface of said connector body to prevent deformation of said flat contact portion and allowing said inclined portion alone to be elastically deformed;

said connectors being engaged with each other, said contact projections abutting with each other and said contact sections being elastically bent by each other so that said projections climb over each other, abut against said inclined portions, slilde along said inclined portions, and are pushed up by said inclined portions, thereby elastically bending said contact sections, said contact projections being brought into contact with said contact sections by an elastic force of said contact sections.

2. A device according to claim 1, wherein said contact projections are rounded.

3. A device according to claim 1, wherein an engaging depth of said contact sections is set such that said contact projection is slid along a predetermined wiping area after said contact projections have climbed over said flat contact portions.

4. A device according to claim 1, wherein one-half portion of said contact section along a direction of height thereof is arranged between said guide surfaces and the other half portion thereof projects upward from upper ends of said guide surfaces.

5. A device according to claim 1, wherein a projection or a recess is formed in said flat contact portion.

6. A device according to claim 1, wherein an average inclination of said inclined portion falls within a range of 3° to 30 °.

7. A device according to claim 1, wherein an average inclination of said inclined portion is about 11°.

* * * * *